United States Patent [19]

Arnold

[11] Patent Number: 4,624,162

[45] Date of Patent: Nov. 25, 1986

[54] APPARATUS FOR AUTOMATIC COIL FEED

[75] Inventor: Jerold W. Arnold, Shelbyville, Ky.

[73] Assignee: General Electric Company, Louisville, Ky.

[21] Appl. No.: 784,945

[22] Filed: Oct. 7, 1985

[51] Int. Cl.[4] ..... B26F 1/40; B26D 5/32

[52] U.S. Cl. ..... 83/74; 83/33; 83/228; 83/250; 226/30

[58] Field of Search ..... 83/74, 72, 33, 228, 83/250, 251; 226/30

[56] References Cited

U.S. PATENT DOCUMENTS

| | | | |
|---|---|---|---|
| 1,916,379 | 7/1933 | Leland | 83/63 |
| 2,880,539 | 4/1959 | Frenkel et al. | 226/32 X |
| 2,986,254 | 5/1961 | Borke | 192/125 |
| 3,107,566 | 10/1963 | Archer | 83/33 |
| 3,124,026 | 3/1964 | Loeffel | 83/62 |
| 3,739,968 | 6/1973 | Bodendoerfer | 226/30 |
| 3,854,359 | 12/1974 | Tagami | 83/212 |
| 4,046,040 | 9/1977 | Bourdo | 83/63 |
| 4,349,997 | 9/1982 | Hayasaka et al. | 226/32 X |

*Primary Examiner*—James M. Meister
*Attorney, Agent, or Firm*—Frederick P. Weidner; Radford M. Reams

[57] ABSTRACT

Apparatus for automatic coil feed of a sheet metal stock strip in progressive dies for punch press die operations which adjust the length of stock strip being intermittently fed to the punch press die while the press is operating. The apparatus comprises feed apparatus for feeding a predetermined length of stock strip to the punch press die which feed apparatus normally operates at a preset feed length. There is a control for maintaining the correct feed length of the stock strip being intermittently fed into the punch press die and includes a correction arrangement operable to mementarily change the preset feed length to supply a correcting length of stock strip to the punch press die. There are two longitudinal arrays of registration openings in the stock strip. A first probe mechanism operable when the stock strip stops to detect non-registration of a registration opening in one array resulting from overfeed of the stock strip and a second probe mechanism operable when the stock strip stops to detect non-registration of an opening in the other array resulting from underfeed of the stock strip. Upon detection of underfeed or overfeed of the stock strip, switches activate the control mechanism to shorten the length of stock strip fed to the punch press die or lengthen the length of stock strip fed to the punch press die as the detection case may be while the press is in an operating mode.

9 Claims, 6 Drawing Figures

APPARATUS FOR AUTOMATIC COIL FEED

BACKGROUND OF THE INVENTION

The present invention is directed to machine tools, and more particularly to apparatus for automatic coil feed of a sheet metal stock strip in progressive dies for punch press die operations which assures that the correct length of stock strip is intermittently fed to the punch press die while the press is in an operating mode.

It is the usual practice in automatic coil feed of sheet metal stock strip for punch press die operations to automatically feed a predetermined length of stock strip to the punch press die for punch operations such as pierce punching of holes through the metal stock strip. Such apparatus, however, is often unable to continuously feed the correct predetermined length of stock strip because of various conditions involving the punch press operation and the metal stock strip being fed to the punch press. For instance, there may be buildup of dirt and oil on the stock strip, variations in temperatures under which the punch press is operating and gage variations of the sheet metal stock strip or other coil imperfections, all of which either alone or in various combinations cause a drift in the accuracy of the feed length of the stock strip for punch press die operations.

As disclosed in U.S. Pat. No. 2,986,254, heretofore in fabricating machines such as in a machine for cutting portions of a predetermined length off the end of a strip as it is intermittently advanced to a cutting tool, feeler members have been utilized to engage the sheet metal stock strip and if the stock strip is improperly positioned a pin engaging a spring loaded actuator of a switch is cammed such that the switch is opened and that switch renders the machine inoperative. This type of machine control is deficient in that the machine operation is shut down and an operator must make the adjustments to the machine or coil feeding apparatus to again realign the metal stock strip correctly and re-initiate operation of the machine. This results in a considerable amount of machine down time and manual labor to correct the misalignment. Other misfeed detectors for machine tools such as disclosed in U.S. Pat. No. 3,124,026 use a device in conjunction with a pilot punch to detect misfeed and terminating operation of the apparatus for manually correcting the feed length.

It is also known to control the length of feed of a web processing machine wherein apparatus is utilized to cut in individual zones on the web must be fed properly and positioned relative to a cutting blade at a predetermined time. Such an arrangement is shown in U.S. Pat. No. 3,739,968 wherein there is a means of detection and correction of potential misregistration by a control system that detects the position of a particular register mark with respect to the cutting blade at a given point in time and the operating cycle of the blade. If it appears that the register mark is in registry, no correction signal is sent by the control system to the correction motor. However, if misregistration is indicated and correction is required, the control system provides an appropriate control signal to the correction motor to momentarily change web-feed length. The control system of this patent is an electronic type of scanner and is not a mechanically operating sensing means that cooperates with the downward movement of the punch press to perform a punching operation.

By this invention, there is provided a means for automatically adjusting the length of stock strip being fed to the punch press die and the automatic adjusting may take place while the press is in an operating mode. Moreover, the apparatus for detecting and controlling overfeed or underfeed of the stock strip is cooperatively arranged with the punch press and operates in unison therewith.

SUMMARY OF THE INVENTION

There is provided apparatus for automatic coil feed of a sheet metal stock strip in progressive dies for punch press die operations. The apparatus comprises feed means for intermittently feeding a predetermined length of stock strip to the punch press die and the feed means operates normally at a preset feed length. Control means for the feed means is provided to maintain the correct feed length of the stock strip being intermittently fed into the punch press die and the control means is operable to momentarily change the preset feed length of the feed means to supply a correcting length of stock strip to the punch press die. There are two longitudinal arrays of registration openings in the stock strip. There is a first probe means operable when the stock strip stops to detect non-registration of a registration opening in one array resulting from overfeed of the stock strip, and a second probe means is provided and operable when the stock strip stops to detect non-registration of the opening in the other array resulting from underfeed of the stock strip. First and second switch means are responsive to detection of non-registration by either the first and second probe means respectively with means responsive to the first switch means for actuating the control means to shorten the length of stock strip feed to the punch press die and also responsive to the second switch means for actuating the control means to lengthen the length of stock strip feed to the punch press die while the press is in an operating mode.

BRIEF DESCRIPTION OF THE DRAWINGS

With reference to the accompanying drawing.

DESCRIPTION OF THE PREFERRED EMBODIMENT

Figure 6:
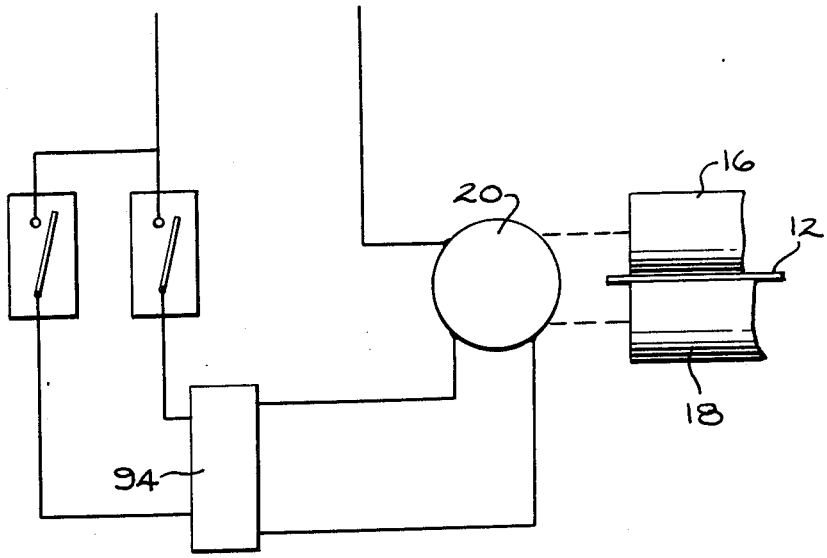
FIG. 6 is a schematic showing the control system for the automatic coil feed apparatus incorporating the present invention.

With reference to the accompanying drawing, there is shown, particularly in FIGS. 1, 2, 3 and 5 a portion of a punch press die 10 that utilizes an automatic coil feed of a stock strip 12, such as for example sheet metal, which is fed into progressive dies for punch press die operations and comprises a feed means 14 including an upper feed roll 16 and a bottom feed roll 18 which are driven by a drive motor 20 (FIG. 6) which by mechanical linkage causes the upper feed roll 16 and bottom feed roll 18 to rotate in unison gripping the stock strip 12 and moving the stock strip in the direction of arrow 22. As in any punch press operation the feed means intermittently feeds a predetermined length of stock strip to the punch press die. That is, the feed means will cause the upper feed roll 16 and bottom feed roll 18 to rotate for a period of time feeding a preset length of stock strip into the press die and then the feed means causes stock strip to stop movement when the correct predetermined length of stock strip has been introduced into the punch press die.

Figure 5:
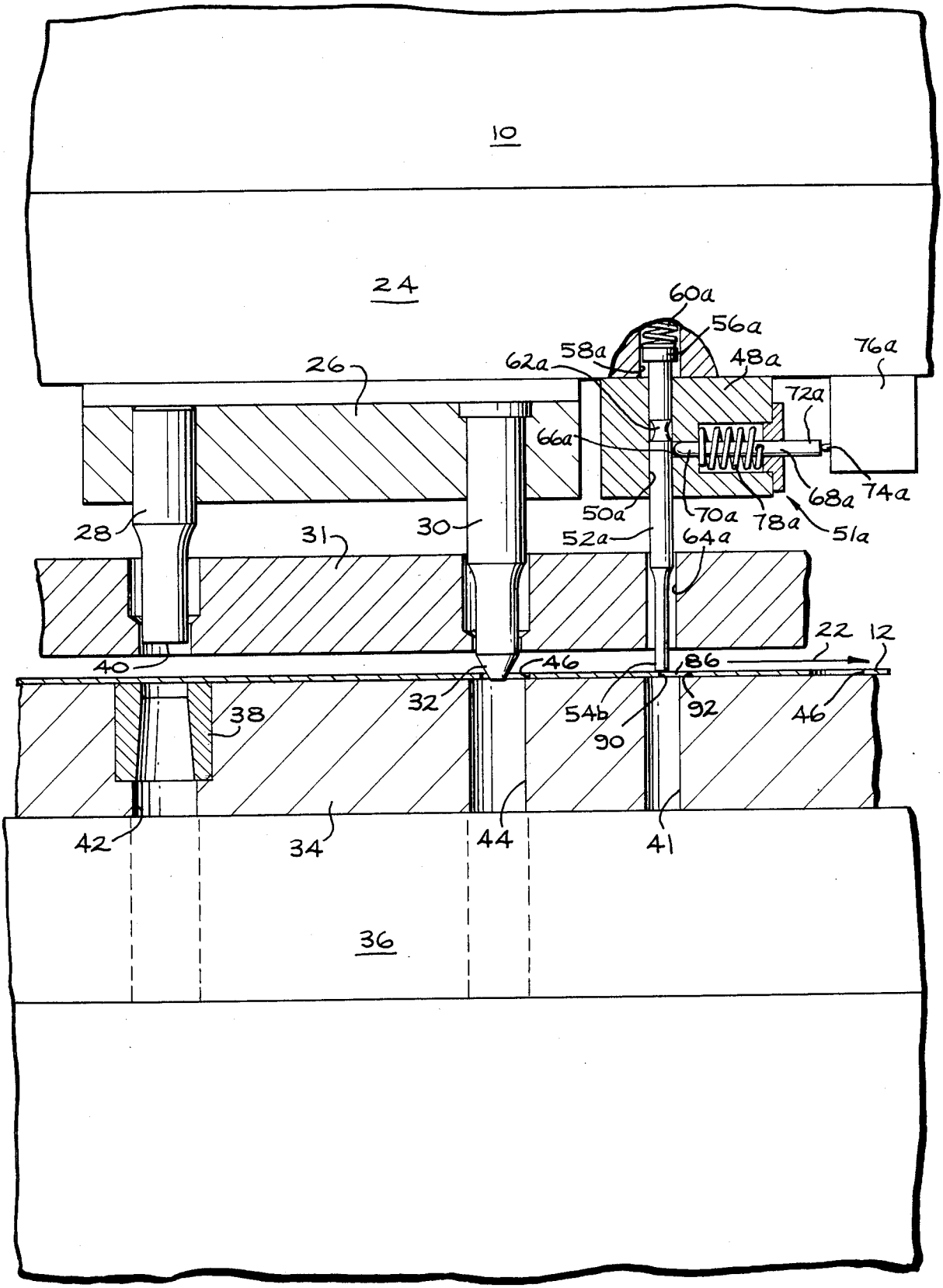
FIG. 5 is a side elevational view taken along line 5—5 of FIG. 3 showing a portion of the punch press die in contact with the stock strip.

As shown, particularly in FIGS. 2, 3, and 5, a portion of the punch press die 10 has a punch shoe 24 below the punch press which punch shoe carries with it a punch retainer 26 which has secured to it a downwardly directed pierce punch 28 and spaced therefrom in a direction of the movement 22 of the sheet metal stock strip 12 a pilot punch 30 which has at its free end thereof a tapered nose 32. Below the stock strip 12 is the base of the punch press which is stationary and includes a die section 34 and underlying the die section is a die shoe 36. In the usual construction of a punch press the die section 34 has a die button 38 which is in vertical axis alignment with the pierce punch 28 which die button receives the cutting end 40 of the pierce punch 28 after it has pierced through the stock strip 12 when the punch press is at the bottom of its stroke. The cut out or pierced portion of the stock strip 12 passes through a cavity 42 through both the die section 34 and die shoe 36 for disposal thereof.

The die section 34 has a cavity 44 in vertical axis alignment with the pilot punch 30 so that the end 32 of the pilot punch may pass into the cavity 44 after passing through an opening 46 previously pierced by the pierce punch 28 and removed from the stock strip 12. The purpose of the pilot punch is well known and is to make minor adjustments in the positioning of the stock strip 12 for the next pierce punch operation thus helping to center and locate the stock strip in its correct position just prior to the punch operation.

Secured to the punch shoe is a pair of spaced apart alignment sensing assemblies 51*a* and 51*b*, the components of each being the same and designated with the same number followed by an a or b in the drawing to distinguish one alignment sensing assembly from the other alignment sensing assembly. Attached to the punch shoe 24 is a guide member 48 with a vertical bore 50 which has located therein a reciprocally movable probe 52 with one end 54 tapered and at the opposite end there is a headed portion 56. The punch shoe 24 has a bore 58 which receives therein the headed portion 56 of probe 52 and also contains a spring 60 which is in compression and biases the probe 52 in the downward direction as shown in FIGS. 2, 3 and 5. The probe 52 has a circumferential detent area 62 located between the tapered end 54 and headed portion 56. The stripper plate 31 also has a bore 64 therethrough which will allow the probe 52 to reciprocate vertically within the bore 64.

Figure 2:
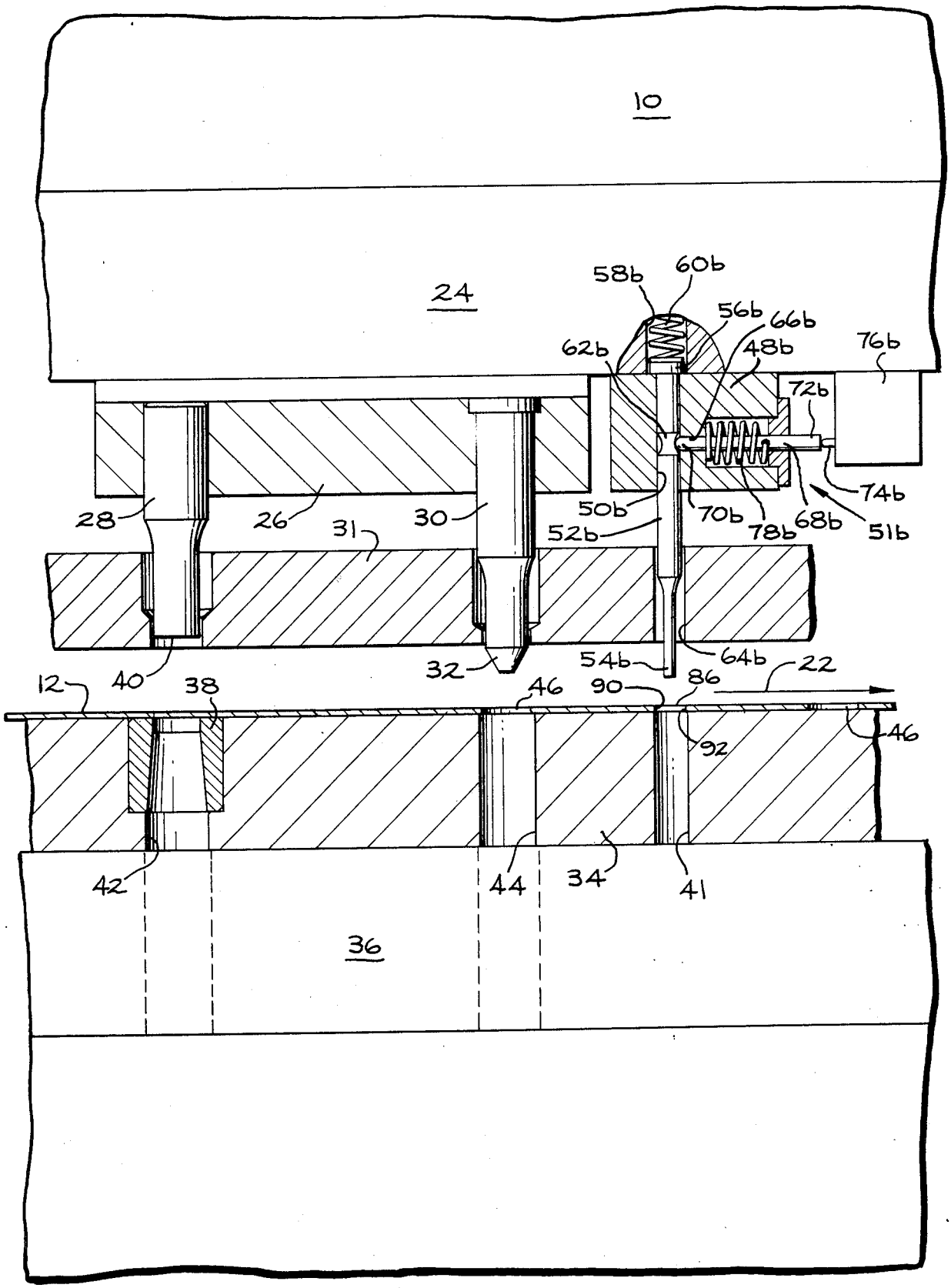
FIG. 2 is a side elevational view of a portion of a punch press die in its open position taken along line 2—2 FIG. 3 incorporating the present invention.

The guide member 48 has horizontal bore 66 which is perpendicular to the vertical bore 50 and has located therein a cam element 68 which is reciprocally movable within the bore 66 and is biased toward the probe by a spring 78 so that the cam element 68 has one end 70 in contact with the detent area 62 when the punch press is in the position shown in FIG. 2. It will be noted that in this position the headed portion 56 of probe 52 abuts the guide member 48 surrounding the bore 58 and is urged into that position or biased by the compression spring 60 exerting a force against the headed portion 56. The end 72 of cam element 68 abuts an actuating button 74 of a switch 76 which is attached to the punch shoe 24 similarly to attaching the guide member 48 to the punch shoe 24. With this arrangement it will be noted that as the punch press closes the punch shoe is moved downwardly carrying with it in unison the punch retainer 26, which has secured within it the pierce punch 28 and the pilot punch 30, and the guide member 48 and switch 76 are also moved downwardly in unison with the punch shoe 24 carrying with them the probe 52 and cam element 68.

Figure 3:
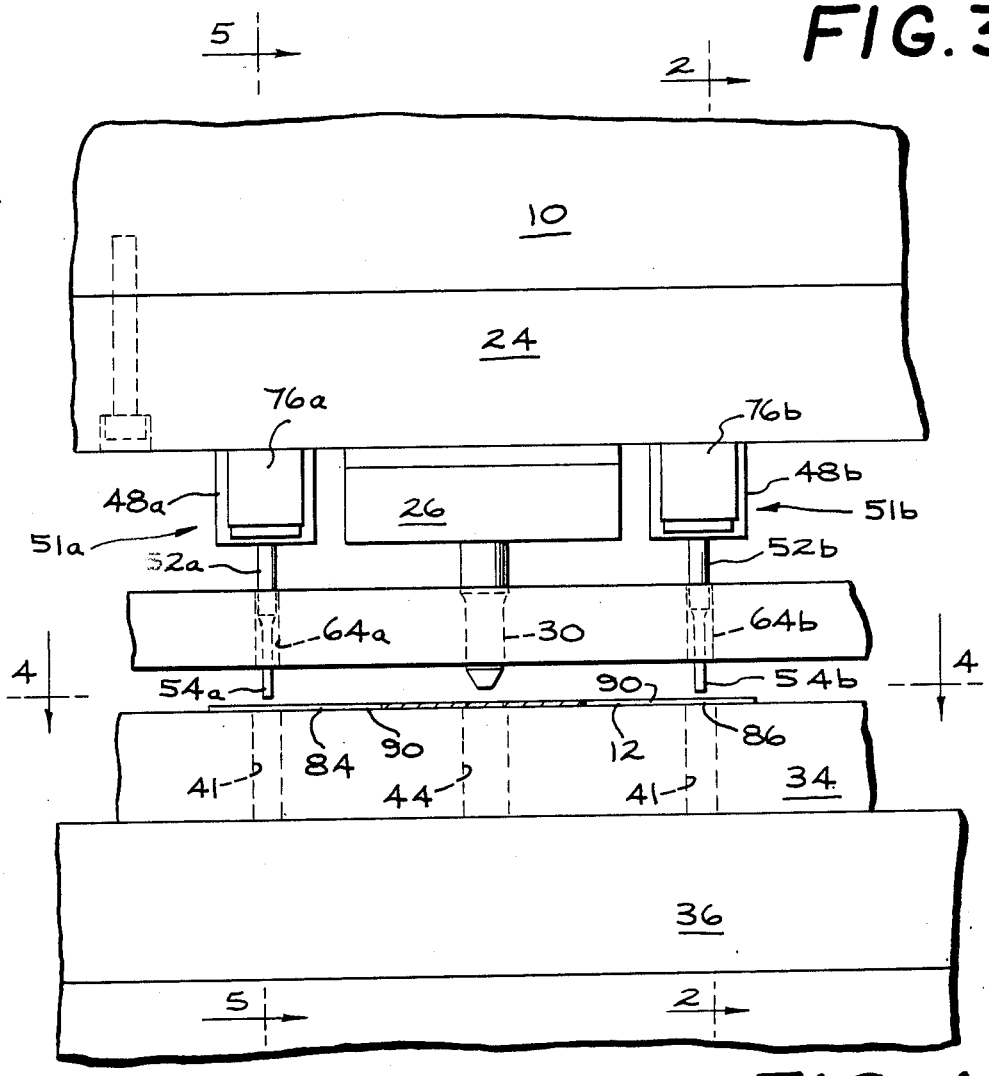
FIG. 3 is a front elevational view of a portion of a punch press die in its open position incorporating the present invention.

While there has been described above the arrangement of the guide member, probe 52, cam element 68, and switch 76, as mentioned previously there are two such assemblies which can be seen particularly in FIG. 3 and they are both slightly inwardly of the outer longitudinal edges of the stock strip 12. There is, however, a difference in their respective locations relative to the stock strip 12. One of the assemblies is located slightly ahead of the other in the direction of movement of the stock strip 12, the purpose of which will now be discussed.

Figure 1:
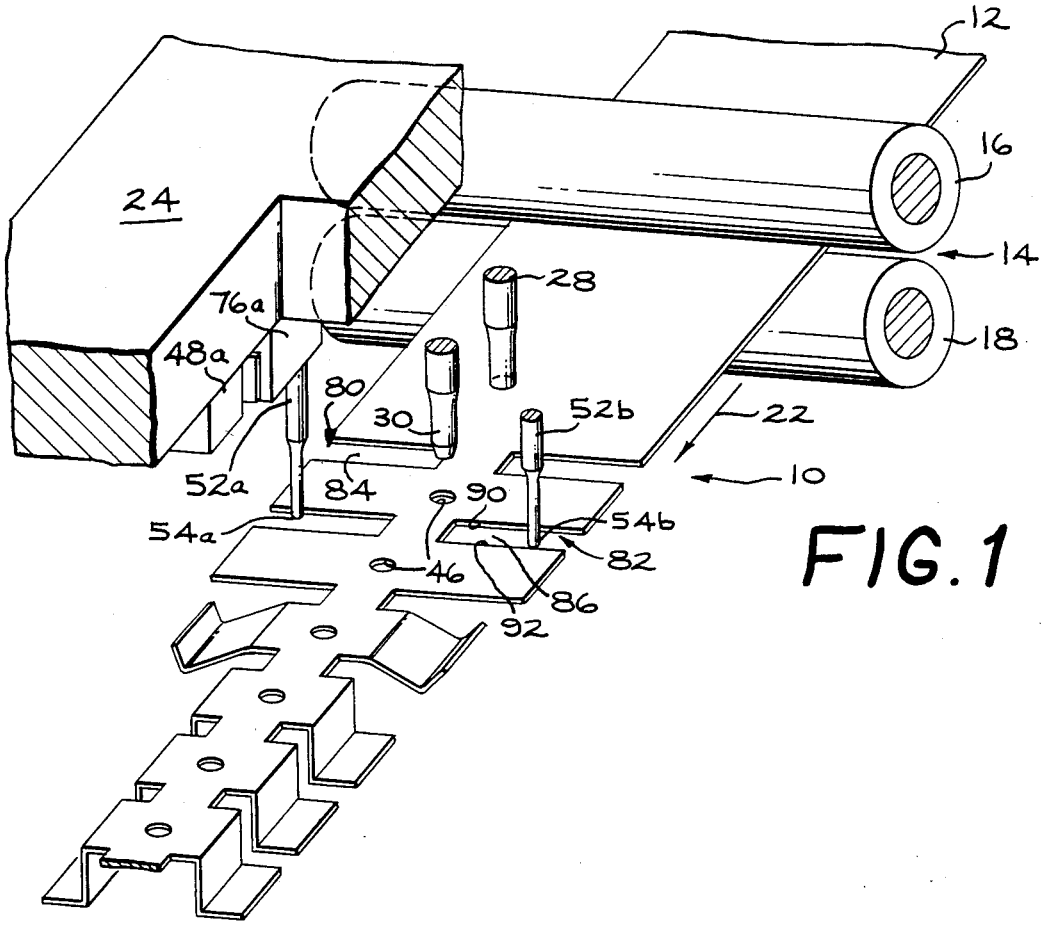
FIG. 1 is a perspective view of a portion of a punch press die and punch press incorporating the present invention.
Figure 4:
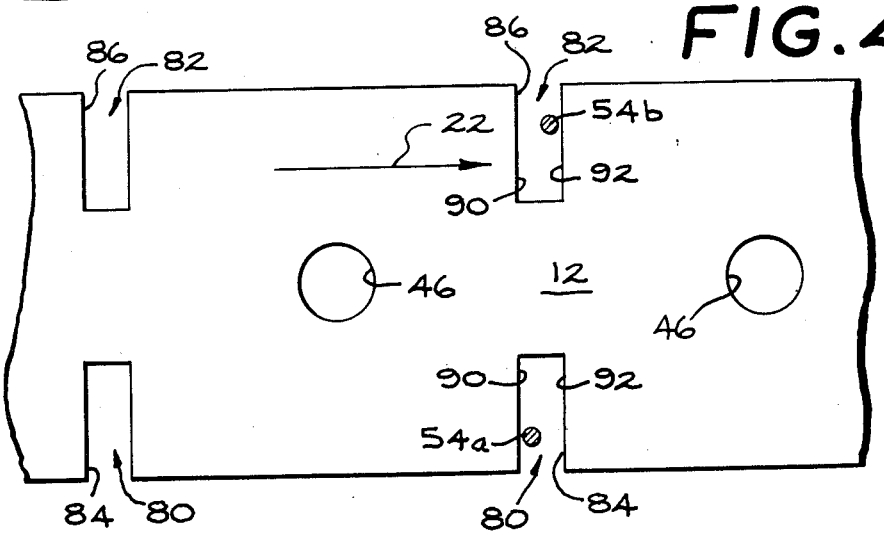
FIG. 4 is a top plan view taken along lines 4—4 of FIG. 3.

With reference particularly to FIG. 1, as in any punch press die operation the stock strip 12 is in progressive dies for punch press die operation and it is important that openings 46 be precisely located relative to the length of the stock strip intermittently introduced to the progressive dies and for that purpose two longitudinal arrays 80 and 82 of registration openings 84 and 86 respectively are provided and in the form as shown they are open slots along each edge of the stock strip. The arrays may also be in the form of hole openings spaced inwardly of the stock strip edge that provide an edge of registry. In the preferred embodiment shown the openings in each array are equidistant apart. It will be noted that the arrays 80 and 82 are on opposite sides of the series of openings 46 which are formed by operation of the pierce punch 28 at that station. While the pilot punch 30 can to some degree help adjust the position of the stock strip 12 just prior to the pierce punch operation, it cannot adjust the length of the stock strip being introduced intermittently each time the punch press opens. With reference to FIG. 4, the relative positions of the probes 52*a* and 52*b* of the alignment sensing assemblies 51*a* and 51*b* respectively is shown. The first probe designated 52*a* and the second probe designated 52*b* are shown relative to the slots 84 and 86 respectively in the stock strip 12. The end 54*a* of probe 52*a* is positioned in close proximity to the side wall of slot 84 which is the trailing edge 90 of the slot for movement in the direction shown by the arrow designated 22. The end 54*b* of probe 52*b* is located in close proximity to the leading edge 92 of slot 82 for movement in the direction shown by the arrow designated 22.

In operation then as the punch press die initiates its operation the punch press and punch shoe and the components carried by the punch shoe are as shown in FIG. 2. As the press closes and the die has been automatically fed a predetermined length of strip, the pilot punch centers through the previously pierced opening 46 to help center and position the stock strip while continued movement of the punch press downwardly causes the pierce punch 28 to contact the stock strip and punch another opening 46 in the stock strip at that location. During this downward movement of the punch press and punch shoe the guide members 48*a* and 48*b* carrying the probes 52*a* and 52*b* and the cam elements 68*a* and 68*b* and switches 76*a* and 76*b* are also moved downwardly in unison with the tapered ends 54*a* and 54*b* of the probes 52*a* and 52*b* passing through the slots 84 and 86 respectively. If, however, the length of stock strip being fed to the die was too long for accurate piercing then the position of the probe 52*a* will be as shown in FIG. 5. As shown therein during closing of the punch press die the tapered end 54*a* of probe 52*a* is prevented from passing through opening 46 and therefore downward movement of the probe 52*a* is stopped while the punch press die, however, continues to move downwardly. With that condition the probe 52*a* is moved upwardly within bore 50*a* of the guide member 48*a* and as a result the cam element 68*a* is displaced from its position in the detent area 62*a* of the probe and is caused to move horizontally outwardly against the actuating button 74*a* of switch 76*a*. The switch may be arranged to signal control means to indicate that the stock strip 12 is being overfed and needs to have the length of stock strip intermittently fed to the punch press die momentarily changed to shorten the stock strip length, thereby providing the correct stock strip length. The probe end 54*a* of 52*a* is positioned as shown in FIG. 4 to indicate when the stock strip has been overfed while end 54*b* of probe 52*b* is positioned to indicate when the stock strip is underfed and operates in a similar fashion; however, the switch signal to the control means will lengthen momentarily the stock strip length. By an appropriate signal from either of the probes 52*a* or 52*b* through their respective switches to a control means, the control means acts to either shorten the length of stock strip fed in response to the first switch associated with probe 52*a* or lengthen the length of stock strip fed to the punch through the second switch associated with probe 52*b*. By appropriate signals from the control means 94 to the drive motor 20 for the feed rolls 16 and 18 an adjustment is made to compensate for either the underfed or overfeed condition and during the next intermittent movement of the feed stock it will correct the length that is introduced into the progressive dies of the punch press. For instance, a signal from either switch through the control means 94 can command a servo motor driven precision lead screw (not shown) to adjust the drive motor 20 and correct the feed in increments as small as 0.001 inch.

The operation described above is schematically shown in FIG. 6 and it is to be understood that various arrangements may be utilized in carrying out this invention and that the invention is only described and shown herein in a general manner since once applicant's invention has been so described a person having ordinary skill may devise various arrangements for carrying out the invention depending upon the particular punch press stock strip feed arrangement, drive system and the control means for the feed arrangement involved.

While there has been shown and described a specific embodiment of the invention, it will be understood that it is not limited thereto and it is intended by the appended claims to cover all such modifications as fall within the true spirit and scope of the invention.

What is claimed is:

1. Apparatus for automatic coil feed of a sheet metal stock strip in progressive dies for punch press die operations comprising:

feed means for intermittently feeding a predetermined length of stock strip to said punch press die, said feed means normally operating at a preset feed length, control means for said feed means for maintaining the correct feed length of the stock strip being intermittently fed into the punch press die, said control means operable to momentarily change the preset feed length of said feed means to supply a correcting length of stock strip to said punch press die, two longitudinal arrays of registration openings in the stock strip, first probe means operable when the stock strip stops to detect non-registration of a registration opening in one array resulting from overfeed of the stock strip, second probe means operable when the stock strip stops to detect non-registration of an opening in the other array resulting from underfeed of the stock strip, first and second switch means responsive to detection of non-registration by either the first and second probe means respectively, and means responsive to the first switch means for activating the control means to shorten the length of stock strip fed to the punch press die and responsive to the second switch means for activating the control means to lengthen the length of stock strip fed to the punch press die while the press is in an operating mode.

2. Apparatus for automatic coil feed according to claim 1 wherein the openings in the stock strip are open slots along each edge of the stock strip.

3. Apparatus for automatic coil feed according to claim 1 wherein the first probe means is located inwardly of and in close proximity to the trailing edge of the registration openings and the second probe means is located inwardly of and in close proximity to the leading edge of the registration openings.

4. Apparatus for automatic coil feed according to claim 1 wherein the registration openings in each array are equidistance apart.

5. Apparatus for automatic coil feed of a sheet metal stock strip in progressive dies for punch press die operations comprising:

feed means for intermittently feeding a predetermined length of stock strip to said punch press die, said feed means normally operating at a preset feed length, control means for said feed means for maintaining the correct feed length of the stock strip being intermittently fed into the punch press die, said control means operable to momentarily change the preset feed length of said feed means to supply a correcting length of stock strip to said punch press die, two longitudinal arrays of registration openings in the stock strip, first probe means operable when the stock strip stops to detect non-registration of a registration opening in one array resulting from overfeed of the stock strip, said first probe means including a vertically reciprocal elongated member having a detent area, a first cam element biased in contact with the detent area of the elongated member at a first position, said first cam element arranged to be removed from the detent area to a second position upon non-registration of the probe with the registration opening, second probe means operable when the stock strip stops to detect non-registration of an opening in the other array resulting from underfeed of the stock strip, said second probe means including a vertically reciprocal elongated member having a detent area, a second cam element biased in contact with the detent area of the elongated member at a first position, said second element arranged to be removed from the detent area to a second position upon non-registration of the probe with the registration opening, first and second swtich means, each having an actuator button in cooperation with the first and second cam elements respectively and actuated in response to the cam element being removed from the detent area, and means responsive to actuation of the first switch means for actuating the control means to shorten the length of stock strip feed to the punch press die and responsive to actuation of the second switch means for actuating the control means to lengthen the length of stock strip feed to the punch press die while the press is in an operating mode.

6. Apparatus for automatic coil feed according to claim 5 wherein the openings in the stock strip are open slots along each edge of the stock strip.

7. Apparatus for automatic coil feed according to claim 5 wherein the registration openings in each array are equidistance apart.

8. Apparatus for automatic coil feed according to claim 5 wherein the first probe means is located inwardly of and in close proximity to the trailing edge of the registration openings and the second probe means is located inwardly of and in close proximity to the leading edge of the registration openings.

9. Apparatus for automatic coil feed according to claim 5 wherein the first and second probes, first and second cams and first and second switch means are arranged to move in unison toward the stock strip when the stock strip stops and one of the probes stops upon engagement with the stock strip in the event of non-registration with the registration opening and the other probe, the cams and switch means continue to move toward the stock strip.

* * * * *